United States Patent [19]

Gherardi

[11] Patent Number: 4,785,697

[45] Date of Patent: Nov. 22, 1988

[54] APPARATUS FOR DIVIDING A CONTINUOUS WEB OF MATERIAL INTO SUCCESSIVE SINGLE SECTIONS

[75] Inventor: Gian L. Gherardi, Medicina, Italy

[73] Assignee: Sasib S.p.A., Bologna, Italy

[21] Appl. No.: 44,427

[22] Filed: Apr. 30, 1987

[30] Foreign Application Priority Data

Jun. 13, 1986 [IT] Italy ..... 12491 A/86

[51] Int. Cl.[4] ..... B26D 1/62

[52] U.S. Cl. ..... 83/346; 83/347; 83/348; 83/674; 83/699

[58] Field of Search ..... 83/346, 347, 348, 674, 83/699, 700

[56] References Cited

U.S. PATENT DOCUMENTS

| | | | |
|---|---|---|---|
| 2,341,503 | 2/1944 | Bombard | 83/346 |
| 2,660,242 | 11/1953 | Lane | 83/674 |
| 3,251,256 | 5/1966 | McGrath | 83/674 |
| 3,709,077 | 1/1973 | Trojan et al. | 83/674 |
| 4,004,479 | 1/1977 | Bodnar | 83/347 |
| 4,240,313 | 12/1980 | Gillespie | 83/346 |
| 4,366,737 | 1/1983 | Bedford | 83/346 |
| 4,444,080 | 4/1984 | Schulz | 83/346 |
| 4,485,710 | 12/1984 | Schlisio et al. | 83/346 |
| 4,537,104 | 8/1985 | Dealto et al. | 83/346 |
| 4,709,607 | 12/1987 | Buhayar | 83/347 |

*Primary Examiner*—Frank T. Yost
*Assistant Examiner*—Scott A. Smith
*Attorney, Agent, or Firm*—Spencer & Frank

[57] ABSTRACT

The invention refers to an apparatus for dividing a continuous web of material into successive single sections, particularly for dividing a web of covering material into successive single bands used in the manufacturing of filter-tipped cigarettes. Such an apparatus comprises a rotary cutting roller with one or more peripheral radial knives which are angularly spaced apart from each other and have their cutting edge parallel to the axis of rotation of the cutting roller. According to the invention, each knife is secured to a knife holder consisting of a bridge-like member having an inherent elastic compressibility in the radial direction, which in the fashion of a beam with a plurality of supports is supported by the cutting roller on two end supports and on one or more intermediate supports. The supports are preferably adjustable in the radial direction, and particularly consist of wedges. The inherent elastic compressibility of the knife holders is obtained by means of slots or slits made in the said knife holders, and which are preferably orderly arranged in at least two radially spaced apart parallel rows extending along the length of the knife holders, and being offset from each other in the longitudinal direction.

19 Claims, 3 Drawing Sheets

APPARATUS FOR DIVIDING A CONTINUOUS WEB OF MATERIAL INTO SUCCESSIVE SINGLE SECTIONS

BACKGROUND OF INVENTION

The invention refers to an apparatus for dividing a continuous web of material into successive single sections, particularly for dividing a web of covering material into successive single bands used in the manufacturing of filter-tipped cigarettes, which comprises a rotary cutting roller with one or more peripheral radial knives which are angularly spaced apart from each other and have their cutting edge parallel to the axis of rotation of the cutting roller, and a rotary counter-roller with one or more peripheral anvils cooperating each with a knife in the cutting roller, and which may be provided with suction ports for holding on the said counter-roller the single sections cut from the web fed about the counter-roller, between this roller and the cutting roller, the knife or knives being each secured to a knife holder which is elastically yieldable in the radial direction toward the axis of rotation of the cutting roller. Such an apparatus is disclosed in the commonly owned co-pending Application Ser. No. 916,733, filed Oct. 8th, 1986.

The object of the invention is to provide an apparatus of the above stated type, in which the knife holders are so improved as to attain an accurate alignment of the knife cutting edges parallelly to the surface of the anvils in the counter-roller, and at the same time as to permit the knives to elastically yield in the radial direction relative to the cutting roller, without using any suitable elastic means, while reducing also any noise and vibration generated by the knives hitting against the anvils in the counter-roller, and ensuring a uniform distribution of the load along the length of each knife.

SUMMARY OF THE INVENTION

This problem is solved by the invention by the feature that each knife holder consists of a bridge-like member which is so made as to have an inherent elastic compressibility in the radial direction, and which in the fashion of a beam with a plurality of supports is supported by the cutting roller on two end supports and on at least one intermediate support.

The end supports and/or the intermediate support or supports for the knife holder bridge-like members are so made as to be preferably adjustable in the radial direction, and they may, for example, consist of wedges. The inherent elastic compressibility of the knife holder bridge-like members may be obtained in any suitable manner, preferably by providing suitably arranged and shaped slots in the knife holders, for example two superposed rows of slots set in an aligned spaced apart relation, the slots in the two rows being parallel to each other and to the knife cutting edges and being mutually offset in the longitudinal direction of said knives.

On cutting, when a knife in the cutting roller hits by its cutting edge against an anvil in the counter-roller, its bridge-like knife holder on a plurality of supports according to the invention, is subjected, thanks to its radial inherent elastic compressibility, to an elastic squeezing in the radial direction, for example, at the two or more sets of mutually offset slots. Thanks to such a radial elastic squeezing, during which a bridge-like knife holder substantially maintains its parallel orientation to the axis of the cutting roller, and thanks to the support of said bridge-like knife holder on more than two supporting points an adjustment of the knife edge to the surface of the anvil on its hitting thereagainst and a uniform distribution of the respective load throughout the length of the knife and the knife holder, are automatically attained. This uniform distribution of the load provides a longer life of the knife edge. The preferred possibility of radially adjusting the end supports of a bridge-like knife holder permits, on the other hand, to guarantee beforehand the parallelism between the cutting edge and the surface of the relative anvil. Conversely, the possibility of adjusting the intermediate support or supports permits to maintain a knife holder always bearing against the intermediate support or supports, and then to avoid any noise generated on cutting by a knife holder hitting against the intermediate support or supports possibly spaced apart from the said knife holder.

A further advantage of the knife holder according to the invention resides in the feature of not requiring any adjustment when the cutting edge of a knife, for example with three or four cutting edges, is worn out, so that a new cutting edge is moved into working position by rotating the knife around its longitudinal axis. In fact, the arrangement and the provision of the slots giving a knife holder its inherent elastic compressibility in the radial direction, permit also any localized small misalignment of a knife holder, so that they allow to compensate for any inevitable small difference, thus promoting the adjustment of the cutting edge of a knife to the surface of the respective anvil.

BRIEF DESCRIPTION OF THE DRAWINGS

These and other features of the invention and the advantages arising therefrom will appear from the following specification of one preferred embodiment thereof, shown by way of a non-limiting example in the accompanying drawings, in which.

DESCRIPTION OF THE PREFERRED EMBODIMENT

Figure 1:
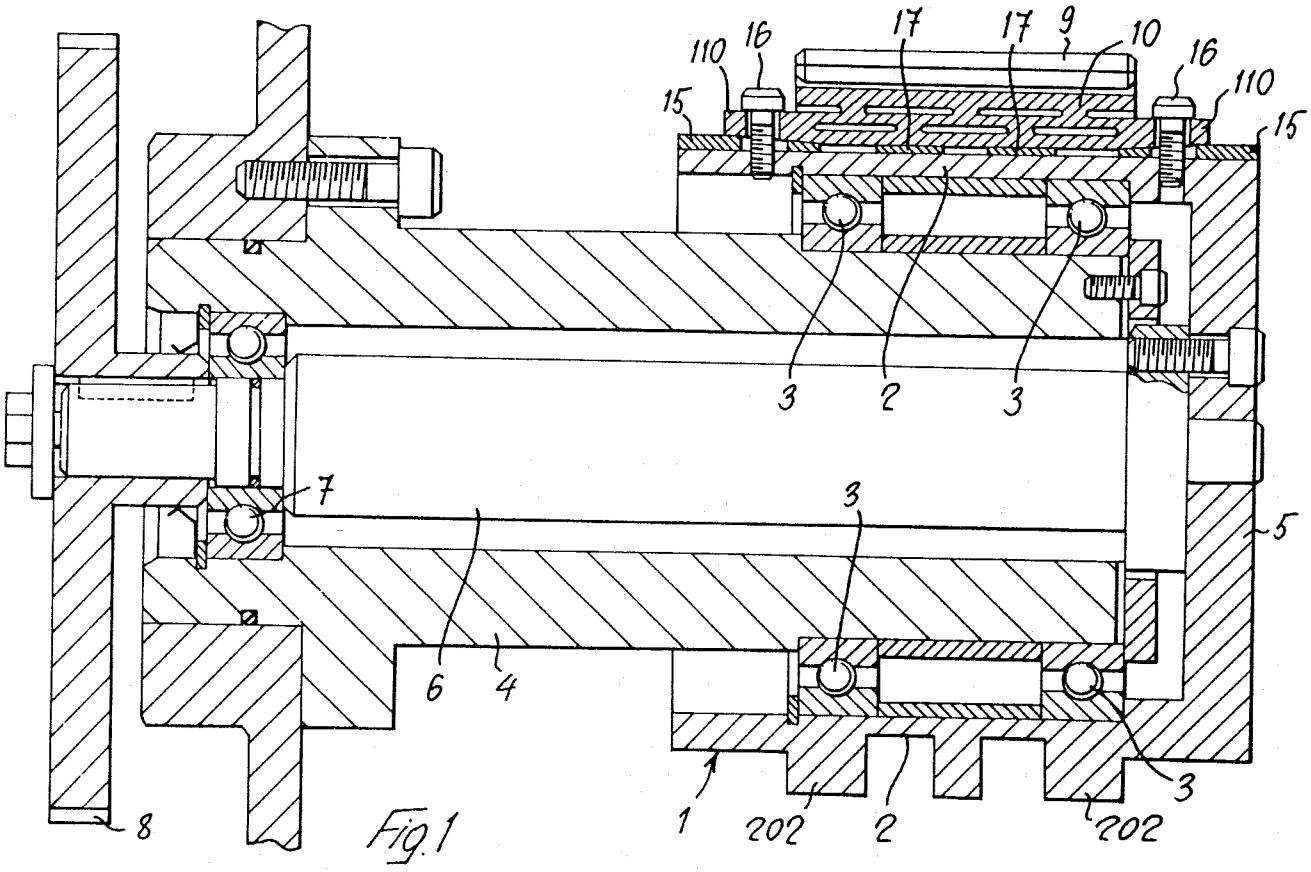
FIG. 1 is a view in longitudinal section showing the cutting roller of an apparatus according to the invention.
Figure 2:
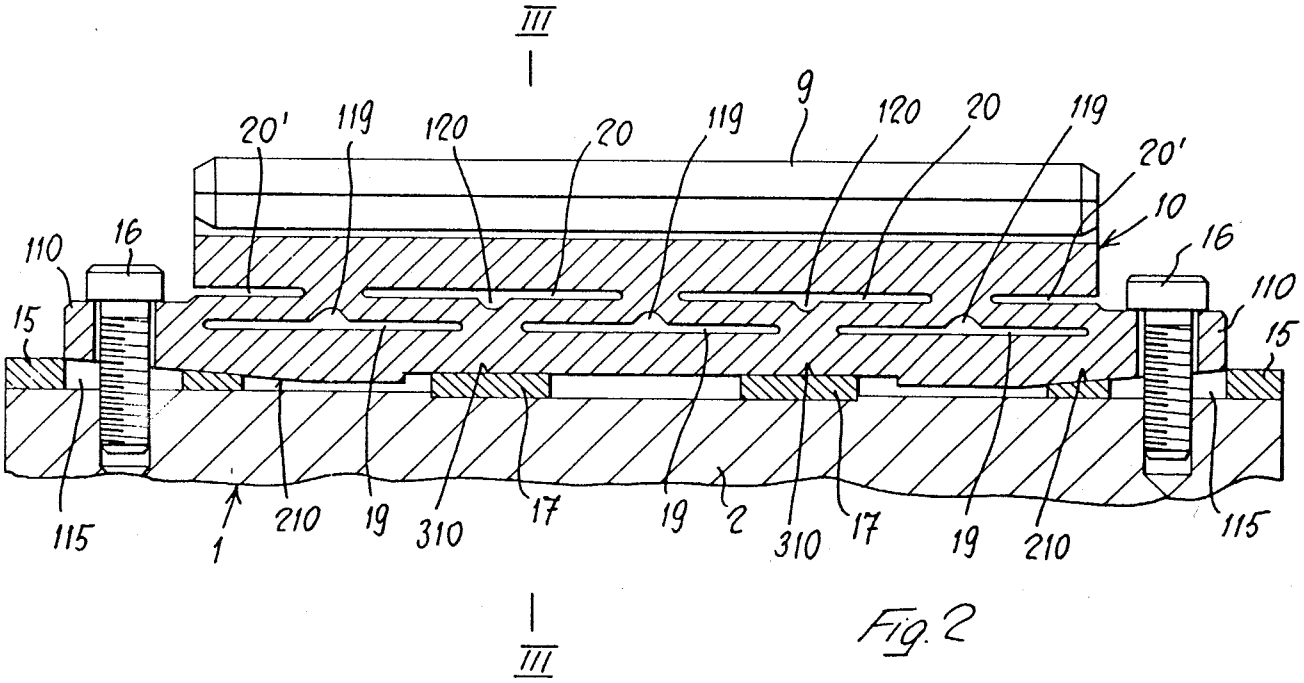
FIG. 2 is a view in longitudinal section, and in an enlarged scale, showing a knife holder on the cutting roller according to FIG. 1.
Figure 3:
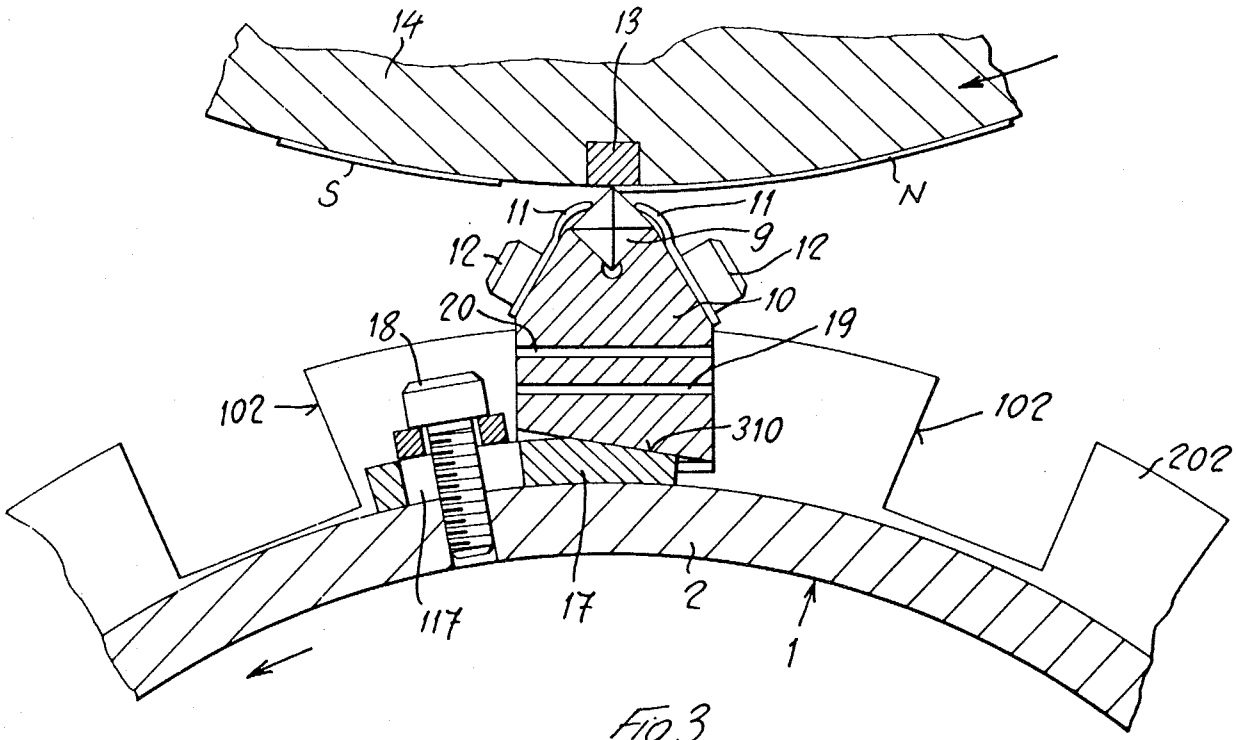
FIG. 3 is a cross-section on line III—III in FIG. 2 through a knife holder on the cutting roller and the matching anvil on the counter-roller, while performing the cutting operation.

In the figures, numeral 1 denotes the cutting roller unit of an apparatus for dividing a continuous web N of wrapping material into equally long successive single sections S. The cutting roller 1 comprises a skirt 2 which through bearings 3 is mounted for rotation about a cantilevered fixed support 4. The skirt 2 has its outward end secured to a disc 5 which in turn is secured to a driving shaft 6 rotatably mounted by means of a bearing 7 in the fixed tubular support 4. The shaft 6 is driven by means of a gearwheel 8 which is integral therewith.

The cutting roller 1 carries on its periphery a plurality of knives or blades 9 which are parallel to the axis of the cutting roller 1 and are set in an angularly equispaced relation. Each knife 9 is secured to the cutting roller 1 by means of a knife holder (blade holder) 10. Each knife holder 10 is provided on its radially outward side with a cradle-like recess serving as seat for the respective knife 9 which has a square profile and four cutting edges. Therefore, the active cutting edge can be changed by fitting knife 9 in a different angular position into the respective seat in its knife holder 20. Each knife 9 may be secured to the respective knife holder 10 in any suitable manner, such as by means of clamping platelets 11 which are fastened to the knife holder 10 by means of screws 12 and partly overlap the said knife 9. Each knife 9 on the cutting roller 1 cooperates with a respective peripheral anvil 13 in a counter-roller 14 on which the web N to be divided into successive single sections S is fed. The cutting of said web N is effected by parting it off from its front side, through the action of the cutting edge of each knife 9 hitting against the respective anvil 13 in the counter-roller 14.

Each knife holder 10 consists of a metal bar having in cross-section a profile which is composed of a rectangular base portion surmounted by a triangular portion having within its apex the seat for a knife 9. The skirt 2 of the cutting roller has in its periphery a plurality of longitudinal grooves 102 made in at least two annular collars 202 of said skirt 2, and a knife holder 10 can be accommodated by its prismatic base portion in each one of said grooves, which in the fashion of a beam with four supports radially bears on the skirt 2 of the cutting roller 1, in correspondence of two spaced apart intermediate supports.

To obtain the end supports, each knife holder 10 has two lateral extensions 110 having each a planar lower surface 210 which is inclined longitudinally of the knife holder 10, in the direction of the axis of the cutting roller 1, toward the center line of the knife holder 10. By their inclined surfaces 210 the lateral extensions 110 of the knife holders 10 bear on the bottom of the respective peripheral groove 102 in the cutting roller 1 with the interposition of matingly inclined wedges 15 which are fitted through the respective extremities of a groove 102 in the longitudinal direction of the knife holders 10. The two longitudinal wedges therefore constitute the end supports for a knife holder 10. The respective extensions 110 of a knife holder 10 are secured to the skirt 2 of the cutting roller 1 by means of screws 16 threaded through relative longitudinal slots 115 in the wedges 15.

The two intermediate supports consist each of a wedge 17 fitted transversely to a knife holder 10, between the said holder and the skirt 2 of the cutting roller 1. The two wedges 17 are spaced apart from each other in the longitudinal direction of a knife holder 10 and cooperate with a lower surface 310 of the knife holder 10, which is matingly inclined transversely to the said knife holder 10. Each transversal wedge 17 can be locked in its position by means of a screw 18 threaded through a slot 117 in the respective wedge 17, and which is screwed down in the skirt 2 of the cuttign roller 1.

The body of a knife holder 10 is so made that it is provided with an inherent elastic compressibility in the radial direction relative to the cutting roller 1. In the shown embodiment, to provide such a compressibility two rows of slits or slots 19 and 20 are made in the metal bar constituting a knife holder 10. The slots 19 or 20 of each row are spaced apart from, and are coplanar to each other and extend through a knife holder 10 transversely thereto. The two rows of slots 19 and 20 are radially spaced apart from, and are parallel to each other and to the cutting edge of knife 9. Moreover, the slots 19 and 20 in the two slot rows are offset relative to each other in the longitudinal direction of a knife holder 10. The arrangement of the slots 19 and 20 is furthermore symmetric relative to the median transversal plane of a knife holder 10. More particularly, in the shown embodiment, one of the two rows of slots, preferably the nearest to the base of a knife holder 10, comprises a central slot 19 and at least two further coplanar slots 19 which are symmetrically arranged each at one side of the central slot, i.e., equispaced therefrom. The other row of slots, preferably the nearest to ,knife 9, comprises at least two coplanar slots 20 which are equispaced from the median transversal plane of a knife holder 10, and are symmetrically offset relative to the slots 19. The said row of slots 20 terminates at each one of its extremities with a shorter lateral slot 20' opening into the respective end surface of a knife holder 10.

All the slots 19, 20 (aside from the shorter lateral slots 20') have in cross-section (in longitudinal section with respect to a knife holder 10) a protuberant profile, i.e., provided with a central boss 119,120. The bosses 119 in slots 19 are turned toward the row of slots 20,20', and are situated intermediately of the solid sections between the said slots 20,20'. The bosses 120 in the slots 20 are turned toward the set of slots 19 and are also situated intermediately of the solid sections between the said slots 19.

The slots 19,20 in the two rows preferably are of a same length and a same width. The distance between the slots 19 preferably is equal to the distance between the slots 20, 20'. Merely by way of a non-limiting example, the distance between the two rows 19,20 approximately corresponds to half the distance between the slots 19,20 in each row, and is about twice the height of the bosses 119,120.

It is understood that the number, the profile, the dimensions, and the arrangement of the slots in the body of knife holders 10 may be varied at will, provided that the same will give the knife holders 10 an inherent elastic compressibility in the radial direction, and substantially uniform in the longitudinal direction of knives 9, while at the same time maintaining the knife holders 10 so rigid as to not require the use of any auxiliary supporting springs.

The above disclosed cutting apparatus according to the invention is set up as follows. The cutting roller 1 and the counter-roller 14 are drawn away from each other and are moved into a rest position in which their cutting interference is eliminated. In this position, the cutting edge of each knife 9 is brought in front of the respective anvil 13, and a knife holder 10 is so adjusted by means of longitudinal end wedges 15 that the cutting edge of knife 9 is arranged exactly parallel to the anvil 13, into contact therewith. After having locked a knife holder 10 in this position by means of screws 16, the intermediate transversal wedges 17 are so adjusted that they are brought into perfect contact with the respective lower surface 310 of knife holder 10, thus providing the intermediate supports therefor. The transverse wedges 17 are thus locked in this position by menas of screws 18. After having adjusted in said manner all the knives 9, the distance between the axes of the cutting roller 1 and the counter-roller 14 is so reduced as to determine the required interference between the cutting edges of knives 9 and anvils 13, for cutting the web N.

I claim:

1. An apparatus for dividing a continuous web of material into successive single segments, comprising:

a rotary cutter having a first axis of rotation extending in an axial direction and a radial periphery;

a cutting blade at said radial periphery, said blade having a cutting edge for cutting the web, extending parallel to said first axis;

a rotary counter-roller for supporting the web, having a second axis of rotation and having an anvil, and being position so that said anvil cooperates with said cutting edge as said rotary cutter and said counter-roller rotate about their respective axes;

a plurality of supports including two end supports and an intermediate support between said end supports, on said rotary cutter; and a blade holder on said plurality of supports holding said blade on said rotary cutter, such that said blade is held elastically yieldable in a radial direction with respect to said first axis, said blade holder having first and second radially spaced apart of slots extending transversely to said axial and radial directions through said blade holder so as to provide elasticity to said blade holder in said radial direction which is substantially uniform in said axial direction, the slots in said first row of slots being axially offset with respect to the slots in said second row of slots, said blade holder having end surfaces at opposite axial ends thereof, the slots of said first row including shortened slots which open into said end surfaces and at least one interior slot between said shortened slots, said shortened slots being shorter in said axial direction than said at least one interior slot, said interior slots of said first row having protuberances respectively projecting toward solid portions of said blade holder between the slots of said second row and the slots of said second row having protuberances respectively projecting toward solid portions of said blade holder between the slots of said first row.

2. An apparatus is in claim 1, wherein at least one of said end supports is adjustable to permit radial adjustment of said blade to adjust the direction of said cutting edge.

3. An apparatus as in claim 2, wherein the direction of said cutting edge is adjusted by said end supports to be parallel to an exposed surface of said anvil when said rotary cutter and said rotary counter-roller are rotated so that said anvil and said cutting edge are opposing each other.

4. An apparatus as in claim 1, wherein said intermediate support is adjustable into perfect contact with said blade holder.

5. An apparatus as in claim 2, wherein said at least one of said end supports comprises at least one first wedge.

6. An apparatus as in claim 5, wherein said at least one first wedge is shiftable in said axial direction to adjust said direction of said cutting edge.

7. An apparatus as in claim 6, wherein said intermediate support comprises a second wedge.

8. An apparatus as in claim 7, wherein said second wedge is shiftable transversely to said axial and radial directions to adjust its contact with said blade holder.

9. An apparatus as in claim 8, wherein said blade holder has radially inward surfaces inclined to mate with said first and second wedges.

10. An apparatus as in claim 9, wherein said first and second wedges have slots and said rotary cutter has a skirt, said apparatus further comprising screw means threadable though said slots in said first and second wedges, for locking said first and second wedges to said skirt.

11. An apparatus as in claim 10, wherein said at least one first wedge comprised two end wedges and said blade holder has extensions, the screw means for the two end wedges being threaded through said extensions and said end wedges to lock said end wedges and said blade holder on said skirt.

12. An apparatus as in claim 1, wherein said rotary cutter has a peripheral groove, said blade holder having a lower portion fitted in said groove.

13. An apparatus as in claim 1, wherein the at least one interior slot of said first row and the slots of said second row have a same width in said axial direction, the spacing between adjacent slots in each of the first and second rows being the same.

14. An apparatus as in claim 13, wherein the at least one interior slot of said first row and the slots of said second row have a same length in a direction transverse to the axial and radial directions.

15. An apparatus as in claim 1, wherein said the slots in said first and second rows are symmetrically disposed and shaped with respect to a radially and transversely extending plane midway between said end surfaces.

16. An apparatus as in claim 1, wherein the spacing between adjacent slots in each of the first and second rows is the same and said protuberances having equal radial lengths, said first and second rows being separated by a distance which is approximately equal to one half of said spacing between adjacent slots and approximately twice the radial lengths of said protuberances.

17. An apparatus as in claim 1, wherein at least one of said first and second rows extends along substantially the entire axial length of said blade holder.

18. An apparatus as in claim 1, wherein the apparatus has a plurality of blades including said cutting blade at said radial periphery, said plurality of blades each having a respective cutting edge for cutting the web, extending parallel to said first axis, said plurality of blades being equiangularly spaced apart with respect to said first axis.

19. An apparatus as in claim 1, wherein said rotary counter-roller has suction ports for holding on said counterroller single sections cut from the web by said blade.

* * * * *